United States Patent [19]

Hruska et al.

[11] Patent Number: 4,563,260

[45] Date of Patent: Jan. 7, 1986

[54] MODIFIED LIQUID PERMEABLE ASBESTOS DIAPHRAGMS WITH IMPROVED DIMENSIONAL STABILITY

[75] Inventors: Louis W. Hruska, Geneva; Shan-Pu Tsai, Mentor, both of Ohio

[73] Assignee: ELTECH Systems Corporation, Boca Raton, Fla.

[21] Appl. No.: 555,807

[22] Filed: Nov. 28, 1983

Related U.S. Application Data

[63] Continuation-in-part of Ser. No. 461,565, Jan. 27, 1983, Pat. No. 4,447,566.

[51] Int. Cl.[4] ..... C25B 11/03

[52] U.S. Cl. ..... 204/283; 204/295; 204/296; 204/252; 428/271; 428/421; 428/422; 428/443; 427/126.4

[58] Field of Search ..... 204/295, 296, 252, 282, 204/283; 428/271, 443, 421, 422; 427/126.4

[56] References Cited

U.S. PATENT DOCUMENTS

| | | | |
|---|---|---|---|
| 3,694,281 | 9/1972 | Leduc | 204/296 |
| 3,928,166 | 12/1975 | O'Leary et al. | 204/282 |
| 3,980,613 | 9/1976 | Bachot et al. | 204/296 |
| 4,182,670 | 1/1980 | Argade et al. | 204/252 |
| 4,186,065 | 1/1980 | Dilmore et al. | 204/295 |
| 4,194,040 | 3/1980 | Breton et al. | 428/421 |
| 4,238,303 | 12/1980 | Fang | 204/295 |
| 4,260,453 | 4/1981 | Hanmer | 428/421 |
| 4,341,596 | 7/1982 | Mucenieks | 204/295 |
| 4,410,411 | 10/1983 | Fenn, III et al. | 204/296 |
| 4,444,640 | 4/1984 | Tsai et al. | 204/296 |

*Primary Examiner*—Paul R. Michl
*Assistant Examiner*—Alex H. Walker
*Attorney, Agent, or Firm*—Arthur S. Collins

[57] ABSTRACT

A blend of fluorocarbon polymers for incorporation into an asbestos fiber slurry for forming into a diaphragm is disclosed. The blend comprises fluorocarbon polymer fibers and fluorocarbon polymer chunks of certain sizes in certain weight ratios. Also disclosed is a diaphragm comprised of the asbestos and two types of fluorocarbon polymers, as well as a method of making same.

16 Claims, No Drawings

MODIFIED LIQUID PERMEABLE ASBESTOS DIAPHRAGMS WITH IMPROVED DIMENSIONAL STABILITY

This application is a continuation-in-part of Applicants' copending U.S. Application Ser. No. 461,565, now U.S. Pat. No. 4,447,566 which was filed Jan. 27, 1983, the disclosure of which is incorporated herein by reference.

BACKGROUND OF THE INVENTION

For a great many years the diaphragm-type cell has been used commercially to electrolyze brine into chlorine and caustic. Almost from the beginning, asbestos fibers have been highly regarded as suitable raw material for the preparation of diaphragm separators for such cells. Most such diaphragms have been formed as a matted fibrous coating on foraminous cathodes, e.g by suction induced deposition of solid matter from a slurry of the asbestos fibers. These supported asbestos diaphragms proved to be quite serviceable for duty as the hydraulically permeable separators in percolating electrolytic cells and were, therefore, widely adopted in the chlor-alkali industry.

In recent years however, the industry has been faced with a rapid escalation in the cost of electric power and other operating expenses. Accordingly, more and more effort has been focused on increasing the operating efficiency of brine electrolysis with considerable emphasis on developing improved electrode assemblies which are more resistant to dimensional changes and deterioration under the continuous, heavy duty service conditions of the modern chlor-alkali cell.

Most of the suggestions for improving the stability and service life of asbestos diaphragms which are found in the published prior art involve the incorporation of some sort of binder material, usually a synthetic organic, polymeric resin. A wide variety of such polymeric resins have been proposed as well as many different techniques for incorporating them in the asbestos diaphragms. In order to illustrate the present state of this art, attention is now directed to the following representative references:

British Pat. No. 1,410,313 (Fenn et al) assigned to Diamond Shamrock Corporation (which is the British counterpart of U.S. Pat. No. 4,410,411): This reference teaches that excellent, dimensionally stable, cathode supported diaphragms can be made using only the simultaneous co-deposition technique from a single composite slurry of asbestos fibers and particulate, thermoplastic fluorocarbon polymer binder.

U.S. Pat. No. 3,853,720—Korach et al: This patent teaches that an asbestos diaphragm can be made more durable without losing electrolyte permeability by impregnating same with a minor amount of a hydrophilic fluorocarbon resin in solution in a organic solvent.

British Pat. No. 1,533,429—BASF Wyandotte Corporation: This patent recommends using hydrophobic fluorocarbon resins as the binding or cementing agent and indicates that such resinous additives can be incorporated not only by using solvent impregnation techniques but also by incorporating the resin directly into the aqueous slurry of asbestos fibers from which the diaphragm is to be formed.

U.S. Pat. No. 4,065,534—Rechlicz et al: This reference states that, for best results when adding the hydrophobic resin binder directly to the aqueous slurry of asbestos fibers, the aqueous medium used to prepare said slurry should be a substantially salt-free solution of alkali metal hydroxide.

British Pat. No. 1,498,733—Hooker Chemicals and Plastics Corporation: This patent indicates that a more uniformly resin-reinforced asbestos diaphragm can be produced by subjecting a preformed and dried asbestos mat to subsequent impregnation with a separate dilute slurry of thermoplastic resin powder rather than by co-depositing both asbestos and resin from a single slurry of the two raw materials.

Moreover, there are disadvantages of conventional asbestos diaphragm modifiers which are overcome by the diaphragm according to the present invention. As far as Applicants are aware, when a conventional diaphragm is operated without spacers between the anode and diaphragm (zero gap), there is an *initial* voltage improvement, but the voltage improvement does not stay. Instead the voltage increases. By the end of the first 2-months of operation, the voltage will be higher than from a conventional cell with spacers. Moreover, when the conventional diaphragm is removed from zero gap service, it falls apart. The surface is swollen and the fibers are penetrating the anode.

Through approaches such as those described in the above references, important gains in the service life and stability of asbestos-type diaphragm separators have already been achieved. However, these gains have not been made without considerable cost because of the expensive nature of the perfluorocarbon polymers which are preferred for use as the resin binders as well as the extra steps involved in the fabrication of the reinforced diaphragms. Accordingly, much research continues to be directed towards finding alternative methods of increasing diaphragm life and operating stability at lower costs.

SUMMARY OF THE INVENTION

The general object of the present invention is to provide improved, resin reinforced, asbestos diaphragms for use in the electrolytic production of chlorine and caustic. More specifically, it is desired to produce such diaphragms which are both dimensionally stable and electrolyte permeable during long periods of continuous service in the electrolytic cells. They are stable enough to operate in the absence of spacers, that is when the anodes and cathodes are directly in contact with the diaphragm surfaces with zero gap. In other words, when used in zero gap operations the diaphragm according to the present invention not only demonstrates an initial voltage improvement, but also *remains stable* for the life of the diaphragm. When removed, the diaphragm surface is still intact and the physical dimensions have not changed.

This invention also provides simple but reliable methods for fabricating such improved diaphragms. Indeed, is also desired to make more effective use of expensive raw materials for said diaphragms with the ultimate objective of achieving maximum savings without compromising the performance of said diaphragms in actual service.

Still other advantages of the present invention will become apparent from the complete description thereof which follows:

In accordance with the present invention, the above advantages are realized by incorporating a binary physical combination of finely divided fluorocarbon polymers in the asbestos fiber slurry. Preferably, the polymers are perfluorocarbon polymers. Generally, the slurry is deposited on the surface of the foraminous cathode to form the diaphragm as a uniform coating thereon. Preferably a pressure differential method, such as vacuum deposition, is used to draw the slurry down on the surface of the cathode, but also the slurry may be formed into a "paper" and then placed on in other ways such as by rolling onto the cathode, or by clamping between electrodes. This binary combination of finely divided fluorocarbon polymers is comprised of between about 5% and about 40% of distinctly fibrous particles and between about 1% and about 9% of chunky (non-fibrous) particles based upon the total weight of the asbestos fibers plus both types of fluorocarbon polymer particles and wherein the proportion by weight of fibrous to chunky particles is between about 2 to 1 and about 8 to 1. In most cases the best balance of overall properties is achieved by using proportions of fibrous to chunky polymeric particles between about 3 to 1 and about 7 to 1 by weight.

An important facet of the present invention resides in a binary combination of finely divided fluorocarbon polymer modifiers preformulated in proper proportions. Preferably, the combination is a free flowing powder admixture which includes a minor amount of a suitable water soluble or water dispersible surface active agent so that said admixture can be readily added and blended into an aqueous slurry of dispersed asbestos fiber raw material. Either non-ionic or anionic wetting agents may be used as the surface active additive in said admixtures with the amount employed generally falling between about 0.5% and about 5% of the weight of the polymeric particles therein.

After the resulting composite slurry is employed to form a matted coating on the foraminous cathode, the coated cathode (after drying) should be subjected to a high temperature heat treatment step which is sufficient to sinter a substantial portion of the polymeric modifier components therein and convert the composite diaphragm into a dimensionally stable interlocked matrix which can withstand prolonged continuous service at high current densities in an electrolytic chlor-alkali cell.

DETAILED DESCRIPTION OF THE INVENTION

The most critical features of the present invention are the chemical and physical characteristics of the individual, finely divided, polymeric components in the binary resinous modifier employed in the present improved diaphragms. Thus, the distinctly fibrous polymeric component should average between about 2 and about 200 microns in equivalent cross sectional diameter and between about 1,000 and about 20,000 microns in length with its representative mean ratio of length to equivalent diameter (the L/D ratio) being substantially greater than 10 to 1 and preferably between about 20 to 1 and about 1,000 to 1. The remaining polymeric component is composed of chunky or non-fibrous resinous particles having characteristic L/D ratios of less than 5 to 1 and averaging between about 0.1 and about 100 microns in equivalent spherical diameter. The most effective binary resinous modifiers are generally obtained by combining a fibrous component which averages between about 5 and about 100 microns in equivalent cross-sectional diameter and between about 2,000 and about 12,000 microns in length with a non-fibrous component the equivalent spherical particle diameter of which averages between about 0.2 and about 75 microns.

The polymers employed in the instant invention are preferably perfluorocarbon polymers, by which Applicants intend to include predominantly fluorinated fluorocarbon polymers.

Therefore the present invention provides for a preformulated, free-flowing particulate blend of resinous modifiers designed for direct incorporation into an aqueous slurry of asbestos fibers prior to forming same into an electrolyte permeable diaphragm separator for an electrolytic cell, said preformulated, free-flowing particulate blend consisting essentially of chunky particles of a perfluorocarbon polymer having an average equivalent spherical diameter of between about 0.1 and about 100 microns, about 2 to 8 parts per part by weight based upon the weight of said chunky particles of highly fibrous particles of the same or another perfluorocarbon polymer having an average length of about 1,000 to 20,000 microns and an average equivalent cross-sectional diameter of between about 2 and about 200 microns, and between about 0.5 and about 5% by weight, based upon the combined weight of both the chunky and fibrous particles of perfluorocarbon polymer, of an effective synthetic organic wetting agent.

The invention also provides for an aqueous slurry comprising asbestos fibers and a blend of resinous modifiers, said slurry being designed for forming same into an electrolyte permeable diaphragm separator for an electrolytic cell, wherein said blend is composed of two distinctly different forms of finely-divided fluorocarbon polymer, namely between about 5% and about 40% of highly fibrous particles and between about 1% and about 9% of chunky particles based upon the total weight of the asbestos fibers plus both forms of fluorocarbon polymer particles, and wherein the proportion by weight of fibrous to chunky polymeric particles is between about 2 to 1 and about 8 to 1.

The invention also provides in a method for producing an electrolyte permeable diaphragm separator wherein said separator is formed mostly of asbestos fibers deposited as a matted coating from a suitable aqueous slurry of asbestos fibers the improvement which comprises forming a matted coating from the slurry as described in the paragraph above, drying the matted coating, and heating the dried coating to between 10° and 100° C. above the crystalline melting point of said chunky particles to effect sintering of fluorocarbon polymer therein and convert said coating to a composite, resin-modified diaphragm separator. The diaphragm separator as just described has excellent long-term dimensional stability when employed under the severe service conditions of a chlor-alkali cell operating continuously under high current density load.

The invention also provides for a diaphragm separator made from the aforementioned slurry and preferably according to the method described in the paragraph above.

The invention also provides for an electrolytic cell employing the above described separator such that there is zero gap between the diaphragms and the anodes and the cathodes.

With regard to the chemical nature of said individual components of the binary resinous modifier, each of them should be derived essentially from thermoplastic fluorocarbon polymers in which the atomic ratio of fluorine to hydrogen is not substantially less than 1 to 1. Prominent examples of such polymers include perfluorinated ethylene-propylene copolymer, polytetrafluoroethylene, polychlorotrifluoroethylene, polyvinylidene fluoride, perfluoroalkoxy ethylene polymers, interpolymers of two or more monomers such as chlorotrifluoroethylene, tetrafluoroethylene, vinylidine fluoride, etc., and copolymers of tetrafluoroethylene or chlorotrifluoroethylene with ethylene in not substantially more than equi-molar proportions. In order to obtain diaphragms with maximum stability, at least the fibrous component should be formed from resins derived wholly or predominantly from perfluorinated or substantially fully fluorinated monomers such as tetrafluoroethylene, hexafluoropropylene, perfluoroalkoxy ethylene and the like. The non-fibrous resin particles may likewise be derived predominantly from prefluorinated polymers and preferably are if the fibrous component is.

In any case however, in forming the subject binary resinous modifiers the respective individual resinous components should be selected so that the crystalline melting point of the non-fibrous component does not substantially exceed that of the fibrous component. In other words, if there is a substantial difference (e.g. more than about 25° C.) between the crystalline melting points of the respective components, then the non-fibrous one should have the lower melting point. For the general class of fluorocarbon polymers specified herein, the crystalline melting points can range all the way from about 160° to about 330° C., with most of those above 240° C. being the preferred perfluorinated resins (i.e. those derived essentially from fully fluorinated monomers). It is accordingly recommended that the spread in crystalline melting points of the respective resinous components chosen be limited to a maximum of 150° C., preferably 80° C., and more preferably to less than about 50° C., so that the resulting diaphragms can be heat treated readily to achieve maximum benefits from both types of resinous modifier.

In the presently preferred mode of practicing the present invention, the perfluorinated resins of choice for forming the fibrous component of the binary resinous modifier are either polytetrafluoroethylene homopolymers or similar high molecular weight polymers derived almost entirely of tetrafluoroethylene and having similar crystalline melting points (e.g. approximately 315° to 335° C.). For example, one suitable fibrous form of such high molecular weight polymer of tetrafluoroethylene is found in the commercially available, die-drawn fibers. These fibers are usually quite regular in cross-section, are available in the desired range of diameters (e.g. in denier between about 1 and 100) and can be cut or chopped into the appropriate lengths, (generally about one-half inch, (about 1.27 cm), or less. However, it is often more convenient or economical to use as all or part of the fibrous components considerably less regularly shaped fibrous forms of tetrafluoroethylene resin the dimensions of which, though quite variable, generally conform quite well to those specified herein. These rather irregular and complex fibrous forms of resin, which are frequently referred to by terms such as "fibrillated" or "fibridized", are generally obtained by subjecting fine particles of the resin to strong shearing forces, preferably at elevated temperatures that are well below the crystalline melting point of the resin. An excellent illustration of such an irregular fibrous form of resin which is suitable for use in the present invention is found in the polytetrafluoroethylene fibrids which are described in the disclosure of U.S. patent application Ser. No. 189,036 filed Sept. 22, 1980 by one of the present inventors and others. (The same disclosure also appears in European Patent Application No. 48617, which was published on Mar. 31, 1982). U.S. patent application Ser. No. 189,036 was abandoned in favor of U.S. C-I-P patent application Ser. No. 362,865 filed Mar. 29, 1982, which has been allowed as U.S. Pat. No. 4,444,640. By this specific reference thereto, the full disclosures of said documents are hereby incorporated in the present application.

For the chunky or non-fibrous component of the binary resinous modifier, a considerably wider choice of suitable, finely divided grades is commercially available in most of the fluorocarbon polymer species of interest, including the preferred perfluorinated polymers. In most cases, the suitable commercial grades include stabilized aqueous dispersions containing anywhere from about 25% to about 65% by weight of the fluorocarbon resin and wherein the average particle size of said resins can vary from less than 1 micron up to about 50 microns and more. Also available commercially in many cases are dry powder products which are usually composed of chunky primary particles in the proper size range from about 1 micron to about 100 microns. Since such dry powders are often obtained from latexes or other aqueous dispersions of the primary resin particles, they often contain secondary agglomerates having dimensions larger than 100 microns. However, when such dry powders have been carefully prepared, the secondary agglomerates therein disintegrate readily in a turbulent liquid medium to release and redisperse the primary particles therein. Finally, chunky fluorocarbon resin particles of proper fineness can be obtained, if necessary by applying cryogenic grinding techniques to resin particles which are coarser than desired.

The preferred process by which the improved cathode supported diaphragm separators of the present invention are produced involves the vacuum-aided deposition of a foraminous cathode of a matted layer of asbestos fibers and the above described finely divided resinous modifiers from a uniform suspension or slurry thereof in an aqueous medium. Generally, the content of insoluble solids in such a slurry totals between about 5 and about 40 grams (preferably between about 10 and about 30 grams) per liter, using the normally desirable aqueous liquid vehicles. These vehicles include, in addition to plain water (with or without added wetting agent therein), such aqueous media as brine solutions, caustic solutions, cell liquors and other solutions containing salt, sodium hydroxide and/or other chemicals native to chlor-alkali operation. The preparation of a suitable composite slurry of such asbestos fibers and resinous modifiers can generally be accomplished, for example through the use of conventional high speed mixers such as turbine or propeller types to disperse these finely divided solid components through the liquid vehicle. Furthermore, the sequence in which these respective solid components are incorporated into such a slurry does not appear to be a critical factor, especially when the non-fibrous resinous modifier to be added is in the form of an aqueous dispersion.

One basic aspect of the present invention is directly concerned with providing the complete binary resinous modifier featured herein in a particularly convenient and advantageous form for incorporation into the starting slurry. Thus, we have found that slurry preparation can be simplified considerably while still assuring consistent high quality of same, if said resinous modifier is provided as a preformulated, free-flowing blend of both components thereof together with a minor proportion of a compatible synthetic organic surface active additive which effectively promotes aqueous wetting of said resinous components. These compatible organic surface active additives are generally employed in proportions of between about 0.5% and about 5% based on the weight of said resinous components and are preferably chosen from the nonionic and anionic wetting agents which are classified as water soluble or water dispersible. For example, sulfonated anionic surfactants such as the dialkylsulfosuccinates are suitable additives, as well as many nonionic wetting agents, including polyoxyethylene derivatives of many organic compounds which contain at least a medium sized hydrocarbon grouping in their molecular structure (e.g. derivatives such as the octylphenoxypolyethoxy ethanols).

The above, ready to use, preformulated, free-flowing blends containing both components of the binary resinous modifiers can be prepared readily by using simple, powder blending techniques whenever the finely divided chunky particles to be employed are available in the dry powder state. Otherwise, the fibrous resin particles and the surface active wetting agent additive should be dispersed thoroughly in the aqueous dispersion of chunky particles by means of an efficient, high speed mixer and the water from the resulting slurry removed very carefully (e.g. by evaporation in a hot gaseous suspension).

The asbestos fibers which make up the major portion by weight of the improved diaphragm separators of the present invention are preferably the well known chrysotile type materials conventionally used for cathode supported, hydraulically permeable diaphragm separators used in the electrolytic chlor-alkali industry. These conventional asbestos fibers are normally classified into two major grades in accordance with their length thus, number 1 long fibers generally have an average length of about ½ inch (1.27 cm) with a range of about ¼ inch (0.635 cm) to 1 inch (2.54 cm), while standard number 2 short fibers range from about 1/32 inch (0.079 cm) to ½ inch (1.27 cm) with an average of about ¼ inch (0.635 cm). Various mixtures of these two grades are often considered most desirable in the present art but other grades or mixtures are also used in many cases, and the present invention is likewise applicable to a wide range of grades. Preferably, the asbestos fibers will account for between about 65% and about 85% of the weight of the improved diaphragm separators of the present invention.

The foraminous cathodes on which the improved diaphragm separators of the present invention are formed preferably by vacuum deposition technique may be any of those devised for use in percolating electrolytic cells. Such cathodes are usually constructed of some type of expanded metal such as iron, steel or other electrically conductive metals and alloys. These expanded metal substrates include various sizes of metallic screen (e.g. six meshes per inch) (6 meshes per 2.54 cm) as well as other wire grid cathodes and, of course, smooth perforated sheet metal, such as the well known Ryerson steel plate cathodes.

After a well-mixed slurry of the proper concentration and composition of asbestos fibers and resinous binders is prepared as described previously herein, the deposition of the solids therein as a uniform, matted, composite diaphragm coating on the cathode surface is preferably accomplished using vacuum dewatering techniques. These techniques can vary considerably in both mechanics and the conditions employed (e.g. the degree of agitation of the slurry, the amount of vacuum used, etc.). However, the vacuum is best applied in a gradual and careful manner, starting with a low level of perhaps 1 to 2 inches (2.54 to 5.08 cm) of mercury and increasing later (e.g. after from about 1 to several minutes) to a higher value, typically from about 10 inches (25.4 cm) to about 25 inches (63.5 cm) of mercury. The thickness of the improved diaphragm separators of the present invention should be between about 1 and about 5 millimeters with the mid-range of about 2 to about 3 millimeters providing the best balance of properties and delivering the optimum performance in a chlor-alkali cell in most cases. Such improved, cathode supported diaphragms, usually having a dry weight of less than 0.5, and preferably less than about 0.4 pound per square foot (less than 2.52, and preferably less than 2.01 kg/m$^2$) of cross-sectional area, exhibit good permeability and outstanding dimensional stability during long term service in chlor-alkali cells operating under high loads, e.g. over 1 ampere per square inch (e.g. over 0.155 amps/cm$^2$). The moisture remaining in said diaphragms after vacuum deposition is generally removed with the aid of heat (e.g. at about 100° to about 150° C.).

The dried, cathode supported diaphragms is next subjected to a final heat treatment step to effect sintering of at least a substantial portion of the binary resinous modifiers therein. This step, which is usually best carried out in an efficient, well-insulated oven, involves bringing the entire diaphragm separator to a suitable temperature level for at least several minutes (e.g. for about 15 to about 60 minutes).

For the resinous modifiers of primary interest herein (i.e. those derived from perfluorinated polymers), a suitable temperature will generally be between about 300° C. and about 375° C., depending largely upon the specific indentity of the respective polymeric components in the binary resinous modifier. Thus, the required sintering temperature should always reach at least 10° C. but not over 100° C. above the crystalline melting point of the chunky or non-fibrous polymeric component and within ±40° C. of (and preferably above) the crystalline melting point of the fibrous polymeric component. This means that sintering temperatures above 330° C. are usually preferred, especially when the fibrous polymeric component is derived predominantly from tetrafluoroethylene, as is usually most desirable. In this manner the fibrous matrix of the diaphragm separator is strengthened and reinforced physically and provided with greater chemical resistance, imparting dimensional stability even in the hostile environment of a chlor-alkali cell operating continuously at high load.

In order to illustrate various operating details involved in the practice of the invention, including some presently preferred embodiments thereof, the following specific examples are presented with the understanding that this is done solely for purposes of such illustration and not to delineate our invention fully or limit same in any way.

EXAMPLE 1

The binary resinous modifier used in this example comprised 25 parts by weight of 6.6 denier die-drawn fibers of polytetrafluoroethylene (PTFE) about ¼ inch (0.635 cm) in length plus 5 parts by weight of polyperfluoroalkoxyethylene (PFA) powder composed of individual particles between about 1 to 100 microns in equivalent diameter with an average particle size of about 57 microns, (sold under the trademark of TEFLON-P$^{RTM}$ by Du Pont Co.).

A total of 30 parts by weight of said binary resinous modifiers together with 0.6 parts by weight of an alkylphenoxypolyoxyethylene alcohol wetting agent sold under the trademark HYONIC*RTM* PE-260 by Diamond Shamrock Corp. and 70 parts by weight of asbestos (grades #1 and #2 in relatively even proportions) were dispersed with the aid of a high speed propeller type mixer in an aqueous solution of about 6% NaOH and about 8% NaCl by weight (i.e. approximately half the strength of cell liquors typically produced in the operation of diaphragm type chlor-alkali cells) to form a uniformly slurry containing about 18 grams per liter of suspended solids.

A mat coating of said solids was then formed on a perforated steel plate cathode (about 5⅜"×5⅜") (about 13.65 cm×13.65 cm) by vacuum-aided slurry deposition. Thus, with the cathode supported in a level position in a filtration funnel connected to a deactivated source of vacuum, about 2.1 liters of said slurry were placed upon the surface of said cathode. Within a few minutes, the vacuum source was activated and carefully applied, increasing gradually to about 12 inches (30.48 cm) of mercury during about 9 or 10 minutes. Said 12" (30.48 cm) vacuum was then maintained for about 10 more minutes to dewater the wet diaphragm mat more completely.

This freshly deposited, cathode-supported diaphragm was dried for about 1 hour at 110° C. in an oven and susequently maintained for 1 hour at a temperature of about 350° C. in order to sinter the resinous fluorocarbon components thereof, thus fixing the dimensions of the finished diaphragm separator produced in situ on said cathode. The weight of the finished, cathode-diaphragm assembly indicated an average mat density of about 1.28 grams per square inch (1.28 g per 6.45 $cm^2$ which is 0.198 $g/cm^2$) in the diaphragm layer.

A continuous service test was then conducted on the finished, cathode-supported diaphragm separator in a laboratory cell in which it was mounted in a direct opposed position from a dimensionally stable anode spaced apart therefrom by a distance of about ⅛" (0.3175 cm). Said cell was operated continuously at about 95° C. and a current density of about 1 ampere per sq. inch (0.155 $amps/cm^2$) for 4 weeks with absolutely no difficulty or sign of instability of any kind. During this test, the current efficiency averaged over 96% of theoretical, the voltage drop was very steady at 2.88 volts (±0.01) and the brine head leveled out at about 3¼" (8.255 cm) by the end of the first week after starting out at around 4" (10.16 cm). The diaphragm separator at the end of this test showed no evidence of swelling, puffing, blistering, erosion or the other types of dimensional instability to which most asbestos diaphragms are known to be highly susceptible during much service.

A similar diaphragm separator made under substantially the same conditions from an asbestos fiber slurry of the same composition except for omission of the PFA powder component showed definite signs of instability in an equivalent test, e.g. an escalation of over 100 millivolts in voltage drop at 1 asi (0.155 $amps/cm^2$) before the 4th week of continuous operation plus some puffing within the interior of the diaphragm indicating the onset of dimensional changes and deterioration.

EXAMPLES 2 AND 3

Four additional cathode supported diaphragms were deposited on similar (5⅜"×5⅜") (13.65×13.65 cm) perforated steel plate cathodes following the general procedure outlined in Example 1. The slurries in each case were made in the same approximately half-strength, synthetic cell liquor and adjusted to a total suspended solids content (asbestos plus resinous modifiers) of about 18 grams per liter. The compositions of the suspended solids and the conditions under which they were deposited from the slurry and heat treated to form the finished diaphragm separators are tabulated in Table IA.

All of these cathode-diaphragm separator assemblies were subjected to continuous service testing in a lab cell under substantially the same operating conditions described in Example 1 with the results summarized in Table IB.

TABLE IA

| EXP. NO. | WT. PROPORTIONS OF SOLIDS: ASBESTOS | FIBROUS RESIN | RESIN POWDER | DEPOSITION AND SINTERING CONDITIONS: MAX VAC. inch | (cm) | SINTER TEMP. | SINTER TIME | MAT. DENSITY OF DIAPHRAGM g/in² | (g/cm²) |
|---|---|---|---|---|---|---|---|---|---|
| 2 | 75% | 20% DD* | 5% PFA | 12 | (30.5) | 360° C. | 1 hr. | 1.19 | (0.184) |
| 2C | 80% | 20% DD* | — | 17 | (43.2) | 360° C. | 1 hr. | 1.2 | (0.186) |
| 3 | 75% | 20% SS* | 5% PFA | 14 | (35.6) | 350° C. | 1 hr. | 1.0 | (0.155) |
| 3C | 80% | 20% SS* | — | 17 | (30.5) | 260° C. | 1 hr. | 1.2 | (0.186) |

*"DD" indicates 6.6 denier, diedrawn PTFE fiber; "SS" indicates PTFE fibrids made by shearing a mixture of PTFE powder and finely divided salt e.g. in a Banbury Mill as described in USSN 189,036. U.S. Pat. Application Ser. No. 189,036 was abandoned in favor of U.S. CIP Pat. Application Ser. No. 362,865 filed March 29, 1982, which has been allowed as U.S. Pat. No. 4,444,640.

TABLE IB

| TEST NO. | DURATION | VOLTAGE INIT. | VOLTAGE FINAL | BRINE HEAD: EARLY inch | (cm) | LATE inch | (cm) | AVER. C. EFF. | FINAL CONDITION OF DIAPHRAGM |
|---|---|---|---|---|---|---|---|---|---|
| 2 | 81 days | 2.82 | 2.90 | 7.5 | (19.1) | 6 | (15.2) | 95% | Excellent and sound throughout. |
| 2C | 8 days | 2.78 | 3.03 | 5 | (12.7) | 3.25 | (8.3) | 92% | Badly puffed in interior. |
| 3 | 74 days | 2.86 | 2.94 | 8 | (20.3) | 11 | (27.9) | 96% | Fully stable, no defects. |
| 3C | 8 days | 3.02 | 3.09 | 7 | (17.8) | 10 | (25.4) | 94% | Serious surface swelling. |

These results clearly demonstrate the long term stability of diaphragm 2 and 3 containing the binary resinous modifiers of this invention, whereas the control diaphragms 2C and 3C, (which contained only the fibrous resin modifiers) were already in poor condition after only about 1 week of service and were incapable of providing stable operation on a sustained basis.

EXAMPLES 4–6

Three more diaphragm separators were prepared on cathodes on the same type and following the same procedures as in Examples 1–3. The composition of the suspended solids in each slurry and the deposition conditions, etc. used to form the finished diaphragm separators are shown in Table IIA.

The results obtained from lab cell testing in the manner already described in previous examples is summarized in Table IIB, showing all three diaphragms to be completely stable in every respect including electrolyte and current flow.

TABLE IIA

| EXP. NO. | WT. PROPORTIONS OF SOLIDS: ASBESTOS | FIBROUS RESIN | RESIN POWDER | DEPOSITION & SINTERING CONDITIONS: MAXIMUM VACUUM inch | (cm) | SINTER. TEMP. | SINTER TIME | MAT. DENSITY OF DIAPHRAGM g/in² | (g/cm²) |
|---|---|---|---|---|---|---|---|---|---|
| 4 | 71% | 25% DD | 4% PFA | 12 | (30.5) | 360° C. | 1 hr. | 1.27 | (0.197) |
| 5 | 71% | 25% SS | 4% PFA | 17 | (43.2) | 360° C. | 1 hr. | 1.08 | (0.167) |
| 6 | 71% | 25% DD | 4% WD** | 17 | (43.2) | 360° C. | 1 hr. | 1.26 | (0.195) |

**WD indicates a fine PTFE powder dispersed in water at 60% by weight and having an average particle size of about 0.2 micron.

TABLE IIB

| TEST NO. | DURATION | VOLTAGE INIT. | FINAL | BRINE HEAD: EARLY inch | (cm) | LATE inch | (cm) | AVER. C. EFF. | FINAL CONDITION OF DIAPHRAGM |
|---|---|---|---|---|---|---|---|---|---|
| 4 | 20 days | 2.88 | 2.88 | 4 | (10.2) | 3 | (7.6) | 93% | Fully stable inside and out. |
| 5 | 23 days | 2.85 | 2.86 | 4 | (10.3) | 3.25 | (8.3) | 94% | Completely intact, unswelled. |
| 6 | 40 days | 2.77 | 2.84 | 4 | (10.2) | 3.75 | (9.5) | 91% | Stable and free of defects. |

EXAMPLE 7

A slurry of asbestos fibers and resinous modifiers in half-strength, artificial cell liquor was prepared with substantially the same composition and concentration of suspended solids as specified for Example 6. This slurry was employed to form a cathode supported diaphragm following substantially the procedures outlined in the previous examples except that the cathode in this case was of wire mesh construction having about 6 meshes per inch in each direction. The matted solids coating on said cathode was deposited with the aid of a gradually applied vacuum which was restricted to a maximum of 17" (43.2 cm) of mercury. After drying, the cathode supported diaphragm was heat treated at 260° C. for 90 minutes, yielding a mat density of about 1.3 g/in² (0.20 g/cm²).

A continuous service test of the resulting cathode-diaphragm assembly was carried out in the lab cell equipment under essentially the conditions described for the first six examples except that the current density was increased to 1.2 asi (0.186 amps/cm²). Said assembly performed very smoothly for about 2 weeks at a voltage drop of about 2.87 to 2.88 volts and a brine head of about 3.5" (8.89 cm) in spite of two power outage interruptions of a few hours duration. Its line test was then completed by transferring said assembly to a different lab cell of identical design for another 10 days of continuous service at 1.2 asi (0.186 amps/cm²) current flow. The voltage drop in the second cell varied very slightly (between 2.86 and 2.90 volts) while the brine head was quite steady at about 3" (7.6 cm). The overall current efficiency averaged about 93%, and the diaphragm was entirely sound and undistorted at the end of said tests.

EXAMPLE 8

This example shows that the diaphragm according to the present invention is stable enough to be employed in a zero gap cell.

A slurry substantially identical to that in Example 7 was prepared, except that the proportion of the water-dispersed, 0.2 um PTFE powder particles was increased from 4% to 6% by weight while the proportion of asbestos was reduced from 71% to 69% by weight. The resulting slurry was then used to form a mat coating on another steel wire mesh cathode, following the deposition and sintering procedure specified in Example 7 except that the heat treatment step was carried out for 1 hour at a temperature of 350° C. yielding a finished diaphragm with a mat density of about 1.38 g/in² (0.214 g/cm²).

The continuous service test on the resulting cathode-diaphragm assembly was conducted in the same type of lab cell as before but in this case the assembly was mounted with the diaphragm face flush against the anode, in other words at zero gap. The test ran for 10 days at 1 asi (0.155 amps/cm²) current density, with a stable voltage drop of about 2.87 to 2.90 and a steady brine of about 10.5 inches (26.7 cm); then for 15 days at 1.2 asi (0.186 amps/cm²) with voltage drop of about 2.95 and brine head of about 13 inches (33.02 cm) and finally for 99 more days at 1 asi (0.155 amps/cm²) at voltage drops of about 2.85 to 2.88 and brine heads of about 9 to 12 (22.86 cm to 30.48 cm) inches. The overall current efficiency for the total 124 day period averaged about 94%, and the diaphragm separator at the end of the test was still in excellent condition.

EXAMPLE 9

This example also shows that the diaphragm according to the present invention is stable enough to be employed in a zero gap cell.

Following substantially the procedures outlined throughout Example 8 another mesh cathode supported diaphragm was prepared at a mat density of 1.38 g/in² (0.214 g/cm²) with the solids composition thereof by weight being about 70% asbestos fibers, 25% "SS" type fibrids (made by shearing a mixture of PTFE powder in a finely divided salt carrier by milling same in a Bunbury mill) and 5% of a perfluorinated ethylene-propylene copolymer powder dispersed in water and having an average particle size of about 0.2 microns. The resulting diaphragm separator also performed well in a continuous line test in a lab cell, exhibiting electrical, chemical and dimensional stability.

Many other substitutions in specific ingredients and variations in the proportions thereof which are shown in the above illustrative embodiments can be made, as will be obvious in the light of the general teachings and relationships which have been expounded in the present specification. For example, instead of using a single type of resinous fiber or fibrid to make up the full complement of fibrous component in one of our improved diaphragm separators, a mixture of fibers of different denier or a mixture of a smooth fiber which an irregular fibrid can be employed with equally satisfactory results. Also, other finely divided, inert minerals or fibrous inorganic fillers can be substituted for up to about 5% of the specified asbestos fibers without significantly detracting from the outstanding advantages of the subject diaphragm separators. All such obvious variations, alternatives and modifications which are clearly within the spirit of the present invention and successfully maintain and secure its characteristic advantages in the manner demonstrated herein are intended to be protected by the following claims.

What is claimed is:

1. In a method for producing a hydraulically permeable diaphragm separator for an electrolytic chlor-alkali cell of the percolating type by deposition of solids from an aqueous slurry of solids including asbestos fibers and finely divided resin particles to form a matted coating of said solids on a foraminous cathode, the improvement which comprises preparing an aqueous slurry comprising asbestos fibers and two distinctly different forms of finely divided fluorocarbon resin particles consisting of between 5% and about 40% of highly fibrous particles and between about 1% and about 9% of chunky particles based upon the total weight of the asbestos fibers plus both forms of fluorocarbon resin particles and wherein the proportion by weight of fibrous to chunky resin particles is between about 2 to 1 and about 8 to 1, dewatering said slurry on a foraminous cathode to deposit a matted coating thereon of asbestos fibers and said resin particles, drying said matted coating thereon, and heating the dried coating to between 10° and 100° C. above the crystalline melting point of said chunky particles to effect sintering of fluorocarbon resin therein and convert said coating to a composite, resin-modified diaphragm separator.

2. The improved method of claim 1 wherein said aqueous slurry also contains between about 0.5 and about 5% of an effective synthetic organic wetting agent based upon the combined weight of both forms of finely divided fluorocarbon resin particles.

3. The improved method of claim 1 or 2 wherein the proportion by weight of said fibrous particles to said chunky particles is between about 3 to 1 and about 7 to 1, and said fibrous particles are prevailingly between about 2 and about 200 microns in equivalent cross-sectional diameter and between about 1000 and 20,000 microns in length, while said chunky particles average between about 0.1 and about 100 microns in equivalent spherical diameter.

4. The improved method of claim 3 wherein asbestos fibers constitute between about 65% and about 85% of the dry weight of the composite, resin-modified diaphragm separator.

5. The improved method of claim 3 wherein said fibrous particles are between about 5 and about 100 microns in equivalent cross-sectional diameter and between about 2,000 and about 12,000 microns in length while said chunky particles are between about 0.2 and about 75 microns in equivalent spherical diameter, and said fibrous particles represent about 10% to about 30% while said chunky particles represent between about 2% and about 7% of the total weight of the asbestos fibers plus both forms of fluorocarbon resin particles.

6. The improved method of claim 1 wherein both the fibrous and the chunky resin particles are derived predominantly from perfluorinated monomers.

7. The improved method of claim 6 wherein at least said fibrous resin particles are derived predominantly from tetrafluoroethylene.

8. The improved method of claim 1 wherein said fibrous resin particles are fibrids exhibiting considerable variations in thickness, mass and degree of branching and fibrillation.

9. The improved method of claim 8 wherein said fibrids are formed by subjecting finely divided resin powder material to strong shearing forces under conditions which stretch, tear and mince same into elongated, partly fibrillated fragments.

10. The method of claim 1, wherein said matted coating is deposited on the face of said foraminous metal cathode, while drawing a partial vacuum on the reverse side of said cathode.

11. The method of claim 10, wherein the dried coating on said cathode is heated to between about 300° C. and about 375° for about 15 to about 60 minutes to effect sintering of fluorocarbon polymer therein.

12. The method of claim 9, wherein said resin powder material is polytetrafluoroethylene and a finely ground, water-soluble solid such as salt is used as an inert carrier and supporting medium for said polymeric raw material as it is subjected to said strong shearing forces to effect its fibridization.

13. An electrolyte permeable diaphragm separator under 5 millimeters in thickness made according to the method of claim 1.

14. An electrolytic cell containing at least one anode, at least one cathode with the diaphragm separator of claim 13 deposited thereon, and means for compressively urging said anode toward said diaphragm.

15. The cell of claim 14, wherein said anode is maintained away from the diaphragm separator via spacers intermediate to adjacent anode-diaphragm surfaces.

16. The cell of claim 14, wherein said anode is compressively urged into direct contact with the diaphragm separator.

* * * * *